US008888437B2

(12) United States Patent
Pandey et al.

(10) Patent No.: US 8,888,437 B2
(45) Date of Patent: Nov. 18, 2014

(54) DUAL-FLOW STEAM TURBINE WITH STEAM COOLING

(75) Inventors: Vishwas Kumar Pandey, Bangalore (IN); Rohit Pruthi, Bangalore (IN); Santhosh Donkada, Bangalore (IN)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 13/276,643

(22) Filed: Oct. 19, 2011

(65) Prior Publication Data

US 2013/0101386 A1 Apr. 25, 2013

(51) Int. Cl.

| | |
|---|---|
| ***F04D 29/58*** | (2006.01) |
| ***F01D 25/12*** | (2006.01) |
| ***F01D 9/04*** | (2006.01) |
| ***F01D 25/14*** | (2006.01) |

(52) U.S. Cl.

CPC ..... *F01D 9/047* (2013.01); *F05D 2260/20* (2013.01); *F01D 25/12* (2013.01); *F01D 25/14* (2013.01)

USPC ..... 415/1; 415/115

(58) Field of Classification Search

CPC ..... F01D 3/02; F01D 9/047; F01D 9/065; F01D 25/08; F01D 25/12; F01D 25/14

USPC ..... 415/115, 116, 117, 1; 416/93 R

See application file for complete search history.

(56) References Cited

U.S. PATENT DOCUMENTS

| | | | | |
|---|---|---|---|---|
| 3,107,084 | A * | 10/1963 | Conrad, Sr. et al. | 415/103 |
| 3,277,652 | A * | 10/1966 | Brown | 60/658 |
| 3,429,557 | A | 2/1969 | Brandon et al. | |
| 3,659,956 | A * | 5/1972 | Brinkman | 415/215.1 |
| 4,150,917 | A | 4/1979 | Silvestri, Jr. | |
| 5,059,093 | A * | 10/1991 | Khalid et al. | 415/115 |
| 6,102,654 | A | 8/2000 | Oeynhausen et al. | |
| 7,101,144 | B2 * | 9/2006 | Haje et al. | 415/115 |
| 7,635,250 | B2 * | 12/2009 | Montgomery et al. | 415/115 |
| 2007/0065273 | A1 | 3/2007 | Cornell | |
| 2009/0217673 | A1 | 9/2009 | Rivas et al. | |
| 2009/0285670 | A1 | 11/2009 | Rivas et al. | |

* cited by examiner

*Primary Examiner* — Edward Look
*Assistant Examiner* — Danielle M Christensen
(74) *Attorney, Agent, or Firm* — Nixon & Vanderhye P.C.

(57) ABSTRACT

A dual flow steam turbine includes coolant passageways which extract coolant steam from the main steam flow paths at locations downstream from the inlet. The coolant passageways conduct the coolant steam through portions of the dual flow steam turbine which are subjected to a high temperature flow. In some cases, the passageways conduct the coolant steam through first stage nozzle boxes and an inlet assembly of the dual flow steam turbine. In some cases, the inlet assembly of the steam turbine includes an annular diaphragm, and a coolant passageway passes through the annular diaphragm to help cool the annular diaphragm.

20 Claims, 6 Drawing Sheets

DUAL-FLOW STEAM TURBINE WITH STEAM COOLING

BACKGROUND OF THE INVENTION

Steam turbines receive an inlet flow of steam which is at very high temperatures and pressures. As a result, the portions of the steam turbine subjected to the high temperature flow of the steam are subjected to extreme operating conditions. To ensure reliability, it is often necessary to fabricate the elements of the steam turbine subjected to the high temperature flow from special materials that are capable of withstanding these extreme operating conditions.

Another approach is to provide cooling to those elements that are subjected to the high temperature flow so that the elements operate at lower temperatures. Providing such cooling can reduce the material requirements, which allows the elements to be made from lower cost materials.

As steam passes along the flow path through a steam turbine, it is gradually cooled. In some instances, steam turbines are designed to extract a portion of the steam passing along the flow path from a downstream location, and the extracted steam is routed to a location near the inlet to cool the elements located at the inlet. Lower temperature steam extracted from the downstream location can effectively cool the elements at the inlet that are subjected to the high temperature flow.

SUMMARY OF THE INVENTION

In a first aspect, the invention may be embodied in a dual flow steam turbine that includes a housing, a rotor rotationally mounted in the housing, an inlet assembly that guides steam into first and second flow paths that extend through the housing, first stage nozzle boxes mounted on the housing, first stage nozzle assemblies mounted between the inlet assembly and the first stage nozzle boxes, and first stage bucket assemblies mounted on the rotor. The dual flow steam turbine also includes first and second coolant passageways that extend from positions adjacent outer tips of the first stage bucket assemblies to a position on an outer side of the inlet assembly. The turbine further includes a third coolant passageway that extends through the inlet assembly from the first and second coolant passageways to an annular space located between the inlet assembly and the rotor. Coolant steam travels along the first and second coolant passageways from the positions adjacent the outer tips of the first stage bucket assemblies to the third coolant passageway, and then along the third coolant passageway to the annular space.

In a second embodiment, the invention may be embodied in a dual flow steam turbine that includes a housing, a rotor rotationally mounted in the housing, an inlet that guides steam into first and second flow paths that extend through the housing, an annular diaphragm located between the inlet and the rotor, first stage nozzle boxes mounted on the housing, first stage nozzle assemblies mounted between the diaphragm and the first stage nozzle boxes, and first stage bucket assemblies mounted on the rotor. The dual flow steam turbine further includes first and second coolant passageways that extend from positions adjacent outer tips of the first stage bucket assemblies to a position adjacent the inlet. The turbine also includes a third coolant passageway operationally coupled to the first and second coolant passageways and that extends, at least in part, through the diaphragm. Coolant steam travels along the first and second coolant passageways to the third coolant passageway, and then along the third coolant passageway to an annular space located between the annular diaphragm and the rotor.

In another aspect, the invention may be embodied in a method of cooling portions of a dual flow steam turbine that includes an inlet assembly that supplies steam to first and second flow paths, first stage nozzle assemblies, a rotor, and first stage bucket assemblies mounted on the rotor. The method includes extracting steam from the first and second flow paths at locations adjacent outer tips of the first stage bucket assemblies, conveying the extracted steam to an annular space located between the inlet assembly and the rotor, and conveying the extracted steam from the annular space back into the first and second flow paths at locations upstream of the first stage bucket assemblies.

DETAILED DESCRIPTION OF THE INVENTION

Figure 1:
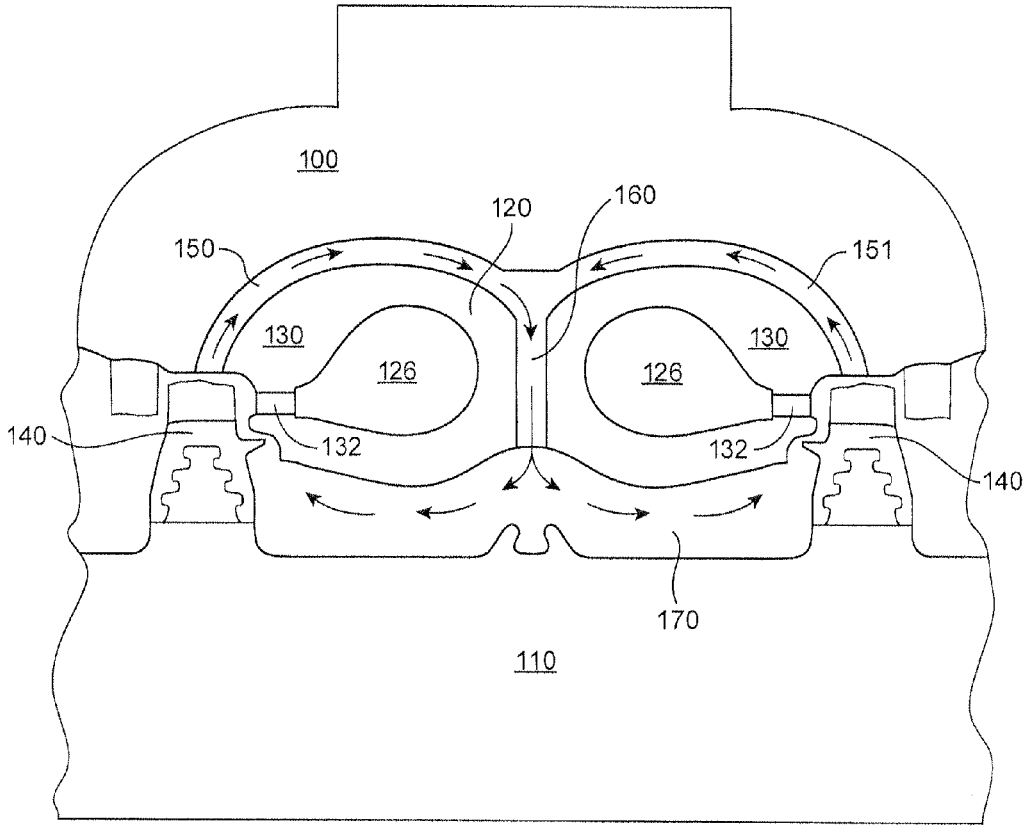
FIG. 1 is a diagram illustrating elements located at the inlet of a first embodiment of a dual flow steam turbine.

Multiple different embodiments of a dual flow steam turbine are disclosed herein. Because a dual flow steam turbine is usually constructed in a symmetrical fashion, a dual flow steam turbine will have first and second flow paths. The first and second flow paths convey steam past first and second sets of nozzles and buckets. In the drawing figures, similar elements along each of a first and second flow path are identified with the same reference numbers.

In the following description, the term "bucket" is used to refer to the rotating buckets or blades that are attached to the rotor of the turbine. Also, the term "nozzle" is used to refer to the stationary nozzles or blades that direct a flow of steam onto a set of movable buckets or blades.

In a first embodiment illustrated in FIG. 1, a dual flow steam turbine includes a housing 100. An inlet assembly 120 guides a flow of inlet steam into first and second inlet flow paths 126. Along each flow path, the inlet steam passes a first stage nozzle assembly 132, which is mounted on a first stage nozzle box 130. Inlet steam then passes first stage bucket assemblies 140, which are mounted on a rotor 110. The inlet assembly 120 forms inlet passageways, and the inlet assembly 120 is also used to support inner ends of the first stage nozzle assemblies 132.

The inlet steam guided by the inlet assembly 120 and which passes across the first stage nozzle assemblies 132 is typically at a very high temperature and pressure. As a result, it is desirable to provide cooling to these elements. If no cooling is provided, these elements must be made from expensive materials to ensure they can withstand the extreme operating conditions. On the other hand, if these elements are provided with cooling, the elements can be made from lower cost materials.

Another problem has to do with an annular space 170 that is located between the inlet assembly 120 and the rotor 110. Steam from the flow paths can migrate down into the annular space 170, but little or no ventilation is provided. The rotation of the rotor 110 relative to the stationary elements causes friction or windage which can cause the temperature of the steam trapped in this annular space 170 to increase beyond the temperature of even the inlet steam. The materials forming the rotor and the inlet assembly must be selected to withstand these extreme operating conditions, which is another factor that drives up the price of the components.

In the embodiment illustrated in FIG. 1, a portion of the steam located adjacent the tips of the first stage bucket assemblies 140, is extracted and used to cool elements of the steam turbine that are subjected to high temperatures. In alternate embodiments, as described in more detail below, the steam may be extracted from a position just downstream from the first stage nozzle assemblies 132, but upstream of the first stage bucket assemblies 140.

As indicated by the arrows appearing in FIG. 1, the extracted steam is directed into a first passageway 150 and a second passageway 151, respectively. The first and second passageways 150, 151 join a third passageway 160 which is located in the inlet assembly 120. The extracted steam is then directed through the third passageway 160 and into the annular space 170 located between the inlet assembly 120 and the rotor 110. The extracted steam then passes along the annular space 170 and ultimately rejoins the first and second flow paths at positions on the upstream side of the first stage bucket assemblies 140.

The steam located adjacent the tips of the first stage bucket assemblies 140 is already at a lower temperature than the inlet steam. Thus, the extracted steam can be used to cool the elements of the steam turbine subjected the high temperature flow.

In addition, merely providing ventilation through the annular space 170 helps to prevent the temperature in the annular space 170 from increasing due to friction or windage. Thus, even if the temperature of the steam circulated through the annular space 170 is at approximately the same temperature as the inlet steam, the flow of steam through the annular space 170 is helpful in keeping the temperature in the annular space 170 lower than it would be without the ventilation.

In the embodiment illustrated in FIG. 1, the first and second passageways 150, 151 pass through the nozzle boxes 130, as well as portions of the inlet assembly 120. Thus, the extracted steam passing along the first and second passageways 150 can cool these elements. The extracted steam also contacts the rotor 110 at locations adjacent the annular space 170 between the rotor and the inlet assembly 120 to help cool the rotor 110.

Because the location adjacent the tips of the first stage bucket assemblies 140 is typically at a higher pressure than the locations around the bases of the bucket assemblies 140, steam will tend to flow in the direction of the arrows illustrated in FIG. 1 to provide cooling for the elements subjected to high temperatures. Steam located downstream of the first stage nozzle assemblies 132 but upstream of the first stage bucket assemblies 140 may be at an even higher pressure than the steam surrounding the tips of the first stage bucket assemblies. Thus, extracting steam from a position upstream of the tips of the first stage bucket assemblies may further help the steam to flow in the direction of the arrows shown in FIG. 1.

In some instances, particularly after the steam turbine has been in operation for a period of time and some wear has occurred, the pressure at the tips of the bucket assemblies 140 may not be equal on both sides of the steam turbine. Further, in some instances the steam turbine may be designed to have different pressures on different sides of the turbine. A difference in the pressures could result in a greater flow rate through one of the first and second passageways 150, 151. Nevertheless, the flow will still travel in the direction indicated by the arrows, to provide cooling and ventilation to the elements subjected to high temperatures.

Figure 2:
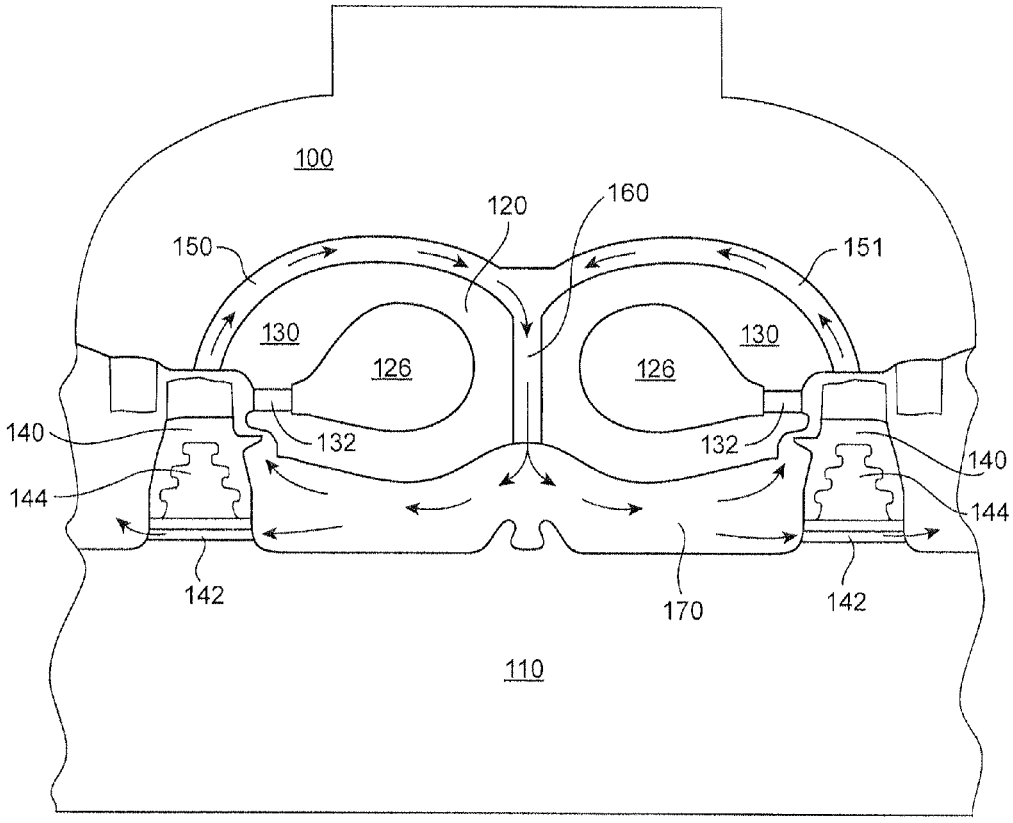
FIG. 2 is a diagram illustrating elements located at the inlet of a second embodiment of a dual flow steam turbine.

FIG. 2 illustrates a second embodiment which is similar to the first embodiment described above. However, the second embodiment illustrated in FIG. 2 includes wheel passageways 142 located through the wheel portions 144 of the rotor 110 that connect to the bucket assemblies 140.

In the embodiment illustrated in FIG. 2, a portion of the flow of the extracted coolant steam located in the annular space 170 between the inlet assembly 120 and the rotor 110 passes through the wheel passageways 142 to locations on the downstream sides of the first stage bucket assemblies 140. This further helps to cool the rotor 110 and the bucket assemblies 140.

Figure 3:
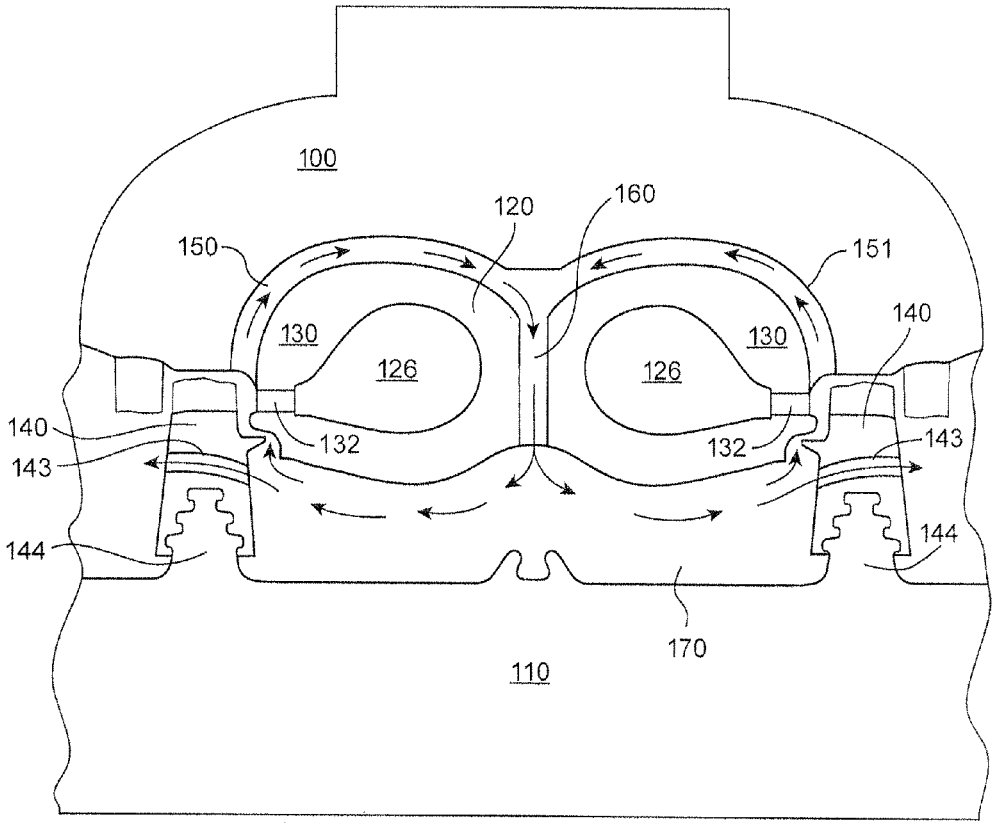
FIG. 3 is a diagram illustrating elements located at the inlet of a third embodiment of a dual flow steam turbine.

The embodiments illustrated in FIGS. 1 and 2 illustrate that the coolant steam is extracted from locations adjacent the outer tips of the first stage bucket assemblies 140. FIG. 3 illustrates an alternate embodiment where the first and second passageways 150, 151 extract steam from locations on an upstream side of the tips of the first stage bucket assemblies 140. As noted above, the steam located between the downstream side of the first stage nozzle assemblies 132 and the upstream side of the first stage bucket assemblies 140 may be at a higher pressure than the steam surrounding the tips of the first stage bucket assemblies 140. Thus, extracting steam as illustrated in FIG. 3 may result in better flow through the first and second passageways 150, 151, the third passageway 160 and the annular space 170.

The embodiment illustrated in FIG. 3 also includes dovetail passageways 143 that pass through the dovetail portions of the bucket assemblies 140. A portion of the flow of the extracted coolant steam located in the annular space 170 between the inlet assembly 120 and the rotor 110 passes through the dovetail passageways 143 to locations on the downstream sides of the first stage bucket assemblies 140. This further helps to cool the bucket assemblies 140.

Figure 4:
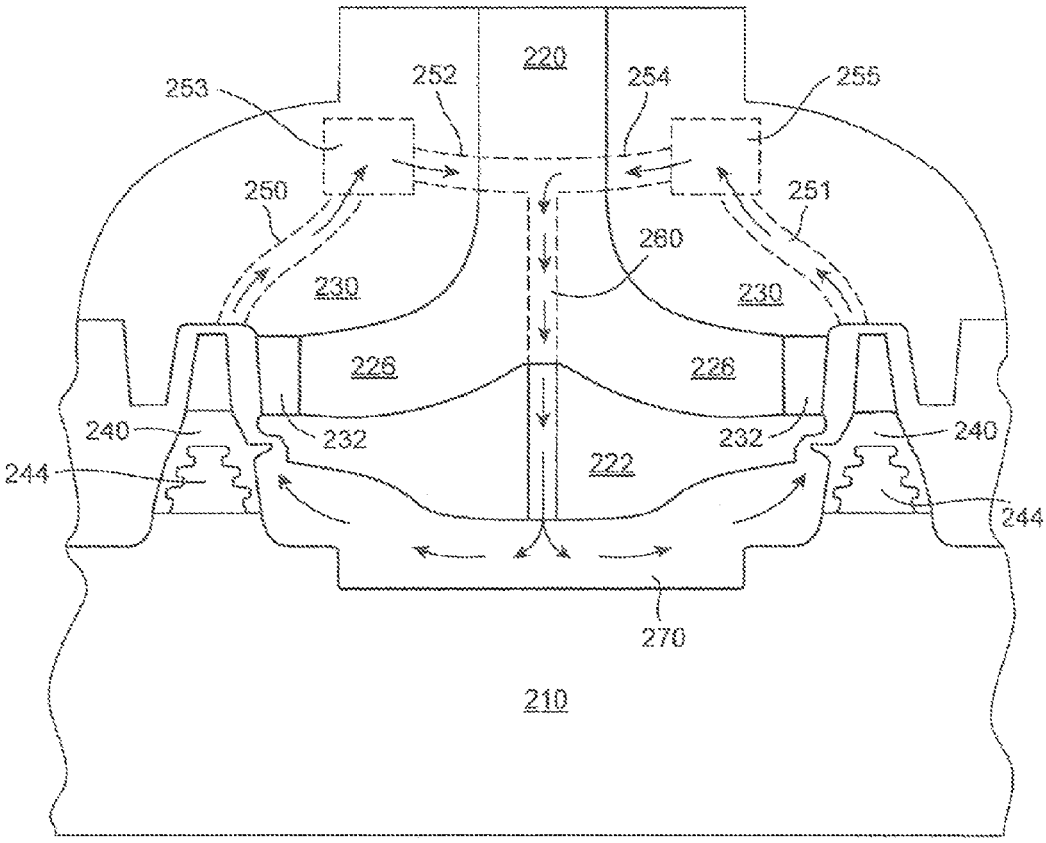
FIG. 4 is a diagram illustrating elements located at the inlet of a fourth embodiment of a dual flow steam turbine.

FIG. 4 illustrates another alternate embodiment which is generally similar to the dual flow steam turbine illustrated in FIGS. 1-3. However, in the embodiment illustrated in FIG. 4, the inlet section is configured differently.

In the embodiment illustrated in FIG. 4, an inlet 220 conducts inlet steam into the dual flow steam turbine. The inlet 220 branches into first and second flow paths 226. An outer surface of an annular diaphragm 222 has a shape which forms portions of the first and second flow paths 226. The annular diaphragm 220 also helps to mount the first stage nozzle assemblies 232, which are also mounted on the first stage nozzle boxes 230.

In this embodiment, first and second cooling passageways 250, 251 extract coolant steam from locations adjacent the outer tips of the first stage bucket assemblies 240. The first and second passageways 250, 251 lead to first and second circumferential passageways 253, 255, respectively.

Each of the circumferential passageways 253, 255 extend around the outer circumference of the inlet assembly. A plurality of first passageways 250 lead from positions adjacent the outer tips of the bucket assemblies 240 to the first circumferential passageway 253. Likewise, a plurality of the second passageways 251 arranged around the circumference of the steam turbine lead into the second circumferential passageway 255.

A plurality of third passageways 252 connect the first circumferential passageway 253 to a corresponding plurality of radial passageways 260. Likewise, a plurality of fourth passageways 254 connect the second circumferential passageway 255 to the plurality of radial passageways 260.

In some embodiments, there will be equal numbers of first passageways 250, second passageways 251, third passageways 252, fourth passageways 254 and radial passageways 260. In alternate embodiments, there may be different numbers of first and second passageways 250, 251, and third 252, fourth 254 and radial passageways 260.

The radial passageways 260 connect corresponding third passageways 252 and fourth passageways 254 to an annular space 270 between the rotor 210 and the annular diaphragm 222.

As shown by the arrows in FIG. 4, the flow of coolant steam passes from the tips of the first stage bucket assemblies 240, along the first and second passageways 250, 250, into the circumferential passageways 253, 255, then into the third and forth passageways 252, 254. The extracted steam then passes along the radial passageways 260 and into the annular space 270 between the annular diaphragm 222 and the rotor 210. The coolant steam passes along the annular space 270 and then back into the first and second flow paths at locations on the upstream sides of the first stage bucket assemblies 240.

Here again, the actual pressures at the tips of the bucket assemblies 240 might be slightly different on either side of the dual flow steam turbine due to wear, or by design. Nevertheless, the steam will flow along the passageways as indicated by the arrows in FIG. 4.

Figure 5:
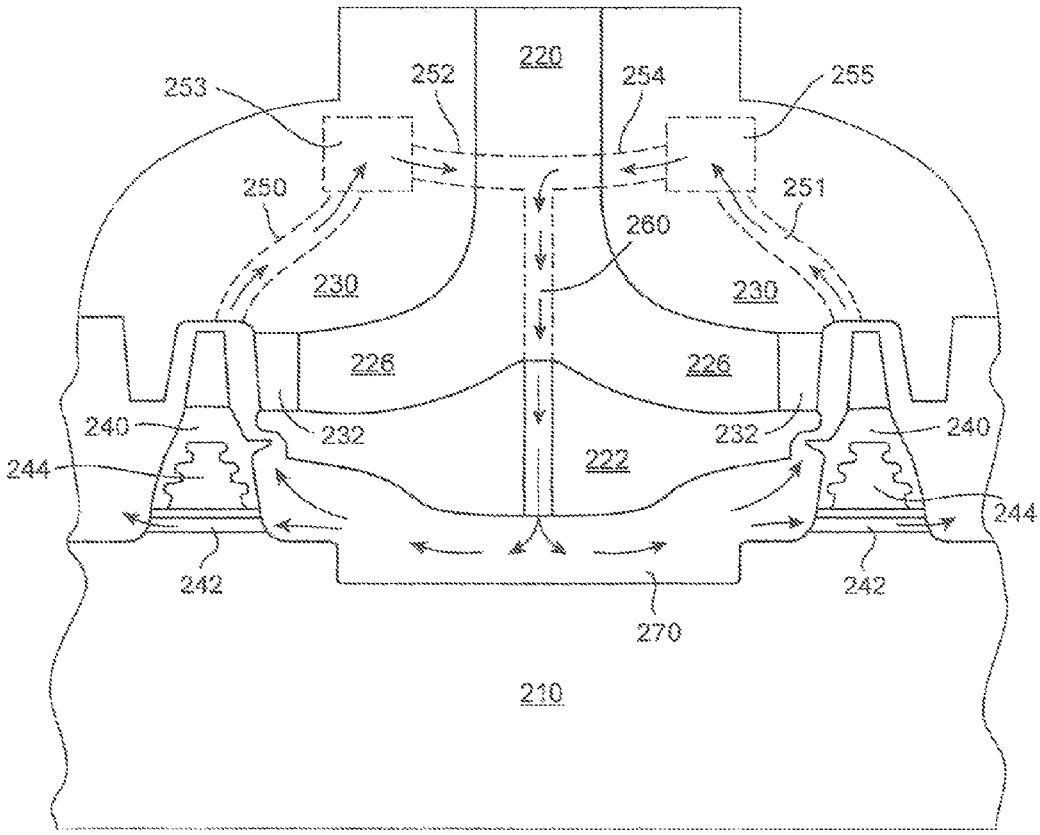
FIG. 5 is a diagram illustrating elements located at the inlet of a fifth embodiment of a dual flow steam turbine.

FIG. 5 illustrates another embodiment similar to the one described in connection with FIG. 4. In this embodiment, wheel passageways 242 are located in the wheel portions 244 of the rotor 210. A portion of the coolant steam delivered into the annular space 270 goes through the wheel passageways 242 to locations on the downstream side of the first stage bucket assemblies 240.

Figure 6:
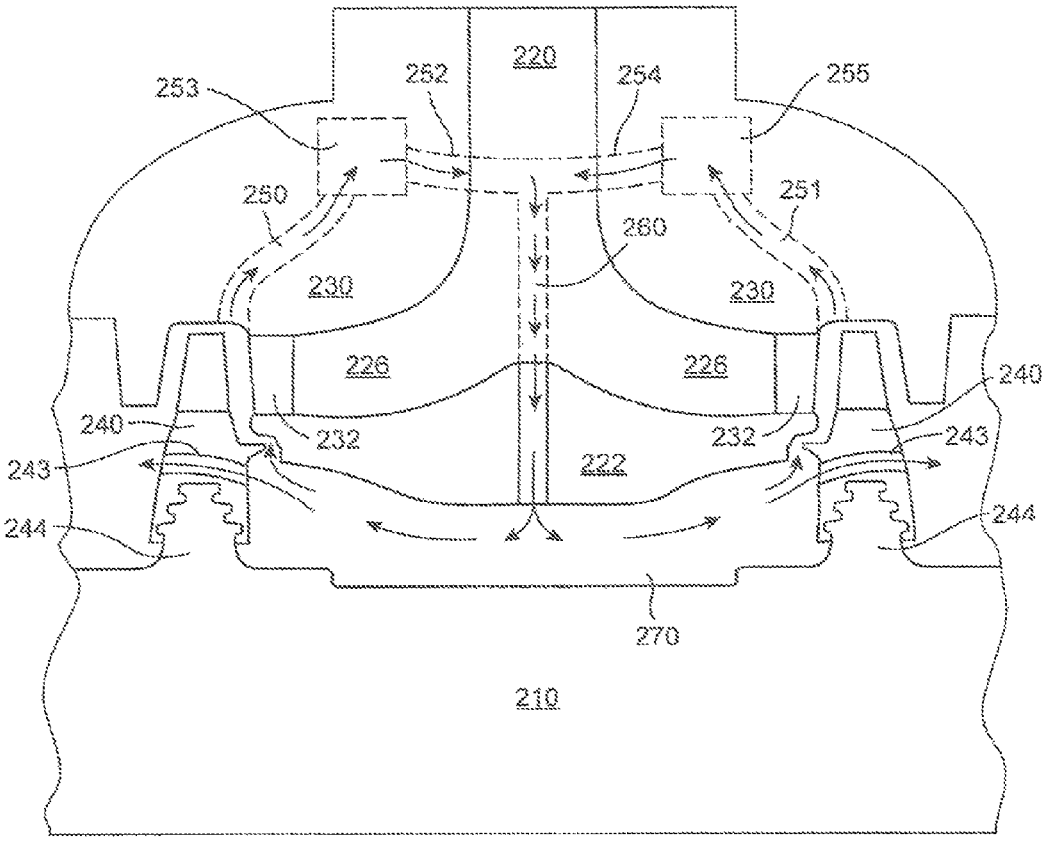
FIG. 6 is a diagram illustrating elements located at the inlet of a sixth embodiment of a dual flow steam turbine.

FIG. 6 illustrates an embodiment similar to the one described above in connection with FIG. 5. However, the first and second coolant passageways 250, 251 extract coolant steam from locations on the upstream side of the tips of the first stage bucket assemblies 240. Because the steam extracted from this location may have a greater pressure, this could result in better flow through the coolant passageways.

In addition, in the embodiment illustrated in FIG. 6, dovetail passageways 243 are located through the dovetail portions of the bucket assemblies 240. A portion of the coolant steam delivered into the annular space 270 goes through the dovetail passageways 243 to locations on the downstream side of the first stage bucket assemblies 240.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dual flow steam turbine, comprising:
- a housing;
- a rotor rotationally mounted in the housing;
- an inlet assembly that guides steam into first and second flow paths that extend through the housing;
- first stage nozzle boxes mounted on the housing;
- first stage nozzle assemblies mounted between the inlet assembly and the first stage nozzle boxes;
- first stage bucket assemblies mounted on the rotor;
- first and second coolant passageways that extend from positions adjacent outer tips of the first stage bucket assemblies to a position on an outer side of the inlet assembly; and
- a third coolant passageway that extends through the inlet assembly from the first and second coolant passageways to an annular space located between the inlet assembly and the rotor, wherein coolant steam travels along the first and second coolant passageways from the positions adjacent the outer tips of the first stage bucket assemblies to the third coolant passageway, and then along the third coolant passageway to the annular space.

2. The dual flow steam turbine of claim 1, wherein the coolant steam travels through the annular space into the first and second flow paths at positions upstream of the first stage bucket assemblies.

3. The dual flow steam turbine of claim 1, further comprising bucket passageways that extend through bases of the first stage bucket assemblies, wherein coolant steam travels from the annular space through the bucket passageways to locations on the downstream sides of the first stage bucket assemblies.

4. The dual flow steam turbine of claim 3, wherein the bucket passageways are located in dovetail portions of the first stage bucket assemblies.

5. The dual flow steam turbine of claim 1, further comprising wheel passageways that extend through wheel portions of the rotor that are connected to the first stage bucket assemblies, wherein coolant steam travels from the annular space through the wheel passageways to locations on the downstream sides of the first stage bucket assemblies.

6. The dual flow steam turbine of claim 1, wherein the first and second coolant passageways extend from positions at the upstream sides of the outer tips of the first stage bucket assemblies to the third coolant passageway.

7. The dual flow steam turbine of claim 1, wherein the first and second coolant passageways extend through and cool the first stage nozzle boxes, respectively.

8. The dual flow steam turbine of claim 1, wherein the inlet assembly comprises an annular diaphragm mounted between an inlet of the turbine and the rotor.

9. The dual flow steam turbine of claim 8, wherein the third coolant passageway extends, at least in part, through the annular diaphragm.

10. A dual flow steam turbine, comprising:
- a housing;
- a rotor rotationally mounted in the housing;
- an inlet that guides steam into first and second flow paths that extend through the housing;
- an annular diaphragm located between the inlet and the rotor;
- first stage nozzle boxes mounted on the housing;
- first stage nozzle assemblies mounted between the diaphragm and the first stage nozzle boxes;
- first stage bucket assemblies mounted on the rotor;
- first and second coolant passageways that extend from positions adjacent outer tips of the first stage bucket assemblies to a position adjacent the inlet; and
- a radial coolant passageway operationally coupled to the first and second coolant passageways and that extends, at least in part, through the diaphragm, wherein coolant steam travels along the first and second coolant passageways to the radial coolant passageway, and then along the radial coolant passageway to an annular space located between the annular diaphragm and the rotor.

11. The dual flow steam turbine of claim 10, wherein the coolant steam travels through the annular space into the first and second flow paths at positions upstream of the first stage bucket assemblies.

12. The dual flow steam turbine of claim 10, further comprising bucket passageways that extend through bases of the first stage bucket assemblies, wherein coolant steam travels from the annular space through the bucket passageways to locations on the downstream sides of the first stage bucket assemblies.

13. The dual flow steam turbine of claim 10, further comprising wheel passageways that extend through wheel portions of the rotor that are connected to the first stage bucket assemblies, wherein coolant steam travels from the annular space through the wheel passageways to locations on the downstream sides of the first stage bucket assemblies.

14. The dual flow steam turbine of claim 10, wherein the first and second coolant passageways extend from positions at the upstream sides of the outer tips of the first stage bucket assemblies to the position adjacent the inlet.

15. The dual flow steam turbine of claim 10, wherein the first and second coolant passageways extend through and cool the first stage nozzle boxes.

16. The dual flow steam turbine of claim 10, further comprising first and second circumferential passageways that extend around the circumference of the steam turbine, wherein the first passageway is coupled to the first circumferential passageway, the second passageway is coupled to the second circumferential passageway, and the first and second circumferential passageways are coupled to the radial passageway.

17. A method of cooling portions of a dual flow steam turbine that includes an inlet assembly that supplies steam to first and second flow paths, first stage nozzle assemblies, a rotor, and first stage bucket assemblies mounted on the rotor, the method comprising:

extracting steam from the first and second flow paths at locations adjacent outer tips of the first stage bucket assemblies, wherein the extracted steam is conveyed through first stage nozzle boxes upon which the first stage nozzle assemblies are mounted;

conveying the extracted steam to an annular space located between the inlet assembly and the rotor; and conveying the extracted steam from the annular space back into the first and second flow paths at locations upstream of the first stage bucket assemblies.

18. The method of claim 17, further comprising conducting a portion of the extracted steam from the annular space through bucket passageways located in bases of the first stage bucket assemblies to locations downstream of the first stage bucket assemblies.

19. The method of claim 17, wherein the extracting step comprises extracting steam from positions located upstream of the outer tips of the first stage bucket assemblies.

20. The method of claim 17, further comprising conducting a portion of the extracted steam from the annular space through wheel passageways that extend through wheel portions of the rotor that are connected to the first stage bucket assemblies to locations on the downstream sides of the first stage bucket assemblies.

* * * * *